United States Patent [19]

Arnold, Jr. et al.

[11] 4,378,462

[45] Mar. 29, 1983

[54] SELF-SUPPORTING AERIAL CABLE AND METHOD OF MAKING SAME

[75] Inventors: William S. Arnold, Jr.; Louis M. Borowicz, Jr., both of Baltimore; Lawrence M. Rackson, Lutherville, all of Md.

[73] Assignee: Western Electric Company, Inc., New York, N.Y.

[21] Appl. No.: 174,315

[22] Filed: Aug. 1, 1980

[51] Int. Cl.[3] ..... H01B 7/18; H01B 13/26

[52] U.S. Cl. ..... 174/70 A; 156/50; 156/54; 156/56; 174/41; 174/105 R

[58] Field of Search ..... 174/41, 70 A, 105 R, 174/107, 115; 156/50, 54, 56

[56] References Cited

U.S. PATENT DOCUMENTS

| | | | |
|---|---|---|---|
| 3,207,836 | 9/1965 | Slechta | 174/41 |
| 3,629,489 | 12/1971 | Jachimowicz et al. | 174/105 R X |
| 3,638,306 | 2/1972 | Padowicz | 174/105 R X |
| 3,681,515 | 8/1972 | Mildner | 174/105 R X |
| 3,785,048 | 1/1974 | Petersen | 174/105 R X |

OTHER PUBLICATIONS

Reale, Jr.; P. J. et al., "Reinforced Self-Supporting Cable-A New Alternative in Protected Aerial Plant Facilities", *Proceedings of the 28th International Wire and Cable Symposium,* Nov. 13-15, 1979, pp. 32-36.

Arnold, W. S. et al., "Squirrel Resistant Aerial Cable", *Western Electric Technical Digest,* No. 52, Oct. 1978, pp. 1 & 2.

*Primary Examiner*—Laramie E. Askin

*Attorney, Agent, or Firm*—E. W. Somers

[57] ABSTRACT

A self-supporting aerial cable includes an undulated core enclosed in an aluminum, inner shield, a plastic inner jacket enclosed in a steel, outer shield having an unjoined longitudinal overlapped seam, and a plastic outer jacket. The outer plastic jacket includes a first portion which encloses the steel shield and a second portion which encloses a steel support strand that extends longitudinally but which is spaced from the first portion, said first and second portions of the outer jacket being connected by a web. The unjoined seam of the outer shield allows forces which are imparted to the steel shield by its formation to be transferred to the inner jacket and the inner shield which causes the inner shield to engage portions of the core to maintain the core coextensive with the inner and the outer jackets.

5 Claims, 6 Drawing Figures

SELF-SUPPORTING AERIAL CABLE AND METHOD OF MAKING SAME

TECHNICAL FIELD

This invention relates to a self-supporting aerial cable and, more particularly, to a self-supporting aerial cable which includes provisions for preserving the transmission capability of the cable notwithstanding attacks by animals and exposure to other damaging forces, and to methods of making same.

BACKGROUND OF THE INVENTION

Telephone and electric power cable which extends between supports above the ground is commonly referred to as aerial cable. It may be extended between supports such as poles by stringing a metallic support wire in a catenary between two points and then lashing a multiconductor cable to the wire. In recent years there has been a trend toward the use of self-supporting aerial cables in which a supporting wire is run parallel with and adjacent to a cable core within a plastic jacket which encloses both the core and the support wire.

The advantages of a self-supporting cable construction should be readily apparent. It is only necessary to manufacture, ship and install a single cable having a common jacket rather than to ship and install a support wire and a separate cable which then must be attached to the support wire under field conditions.

The principal feature of self-supporting sheath cable is the incorporation of the stranded support wire which may be made of steel, for example, within the plastic outer jacket. Because of the weight of the cable in a catenary between two supports, the stranded wire undergoes some elongation during aerial placement of the cable. Moreover, because the outer jacket is common to the wire and because of its elastic properties, it undergoes the same extension. Provisions must be made for preventing transmission of the longitudinal strain, which accompanies such an extension, to the conductors to avoid undesirable capacitance effects while at the same time ensuring that the conductors are coextensive with the jacket so that they are accessible for splicing or terminating after the cable has been installed.

The above-mentioned problem has been overcome by the self-supporting sheath cable construction shown in U.S. Pat. No. 3,207,836 which issued on Sept. 21, 1965 in the name of H. C. Slechta. A core length which is somewhat in excess of sheath length is furnished by an undulation of the core prior to the application of a loosely fitted sheath. More specifically, a multiconductor cable core is set in an undulated form within an aluminum shield together with a stranded metallic support wire and both the support wire and the undulated core are enclosed in a common protective jacket. The undulations in the core permit the core to elongate within the metallic and plastic sheath without detrimental effects due to elongation of the support wire.

While the above-described cable design overcomes problems brought on by the method of support, aerial cable because of its exposure must have suitable provisions for substantially maintaining its integrity as a transmission means. Damage to aerial cable by squirrels and other sheath-chewing animals is a continuing problem. Due to unpredictable migrating patterns, outside telephone plant areas which had been thought to be safe from these animals are sometimes suddenly invaded, requiring the use of continuous protection along cable runs.

Various cable guards exist for protecting cables from damage by squirrels and other animals. One prior art aerial guard which is lashed to a cable is shown in U.S. Pat. No. 3,772,451. Another is self-locking and comprises a longitudinally elongated body having an inverted V cross-section with the legs of the V bent inwardly toward each other to define a substantially enclosed cavity for receiving and locking onto the aerial cable. See U.S. Pat. No. 4,159,395 which issued June 26, 1979 in the name of N. J. Cogelia.

The basic concept of a cable guard is to provide a barrier of relatively hard, slippery plastic around the cable which will prevent the animal from directly attacking the jacket of the cable so that any damage will be encountered by the guard and not the jacket. Also, the configuration of the guard and its slippery surface combine to eliminate a path of travel for animals along the cable.

Cable guards are most advantageous for applications in which operating companies are concerned with preventing additional damage to a cable which is already in use. The installation of cable guards necessitates an after-the-fact identification of problem areas, that is damage must have occurred before preventive measures are taken. Also, while guards provide means for preventing future jacket damage, their use requires more than an insignificant investment of capital.

As an alternative to the use of guards, thought has been given to a cable which itself includes provisions for withstanding attack by squirrels and for preventing the disruption of service. One cable design which has come into recent use and which is referred to as a reinforced aerial cable includes a core, comprising a plurality of polyethylene insulated conductors and being undulated as is shown in U.S. Pat. No. 3,207,836. Surrounding the core is a corrugated aluminum shield covered by a polyethylene inner jacket. A paper wrap is placed around the inner jacket to serve as a heat barrier during the subsequent soldering of a seam of a corrugated steel tape which is formed about the inner jacket. The inner jacket separates the aluminum shield from the steel shield thus preventing the possibility of moisture-originating corrosion between the two metals. The steel shield and a support wire that extends coextensively with the steel shield are enclosed in a common outer plastic jacket.

Problems which have been experienced in the field with cable of this so-called reinforced design include difficulties in the spiralling of the cable to inhibit wind-induced vibration which is prevalent in unobstructed areas. Another problem with this design has been the relative movement between the core and its covering shields and jackets such that it is not coextensive with the shields and the jackets. This requires that end portions of the covering shields and jackets be removed to gain access to the core.

These problems appear to derive from the tubular rigidity of the soldered steel member. Undulated core acts somewhat like a corrugated member in which the wave form can be compacted or extended. The priorly made, single shield, single jacket sheath is relatively compliant and tends to deform sufficiently during reeling to restrain the compacting of core, but readily permits the allowable extension. Apparently, however, the circularity which is maintained by the presence of the soldered steel in the reinforced design leaves the core free to compact as well as to expand. Inertial and gravitational forces which occur during cable unreeling and placement can be sufficient to cause the undulated core to settle or compact within the sheath.

What is needed is a self-support aerial cable which resists attack by animals and which overcomes the above-mentioned problems of spiralling and of core retraction. The prior art includes U.S. Pat. No. 3,638,306 which issued to H. N. Padowicz on Feb. 1, 1972 and which includes a core that is enclosed in an aluminum shield, having a longitudinal unsoldered seam and being coated with a waterproof material, in a steel layer having unsoldered overlapping edges, and in an outer jacket made of a plastic material.

SUMMARY OF THE INVENTION

The foregoing problems have been overcome by a cable of this invention in which an undulated core is enclosed in an inner sheath which includes a first metallic shield and an inner jacket, and in an outer sheath which comprises a second metallic shield having an unjoined longitudinal seam and an outer jacket. The outer jacket also encloses a steel stranded wire which extends parallel to the shield but which is spaced from the outer shield and which is used to support a length of the cable between two outside plant poles, for example.

The freedom of the unjoined overlapped portions of the longitudinal seam of the outer shield allows the outer shield to transfer compressive forces which are imparted to it during its formation and by the extruded outer jacket to the inner sheath. This causes the inner jacket to contract about the undulated core and prevents retraction of the core within the jackets under field conditions. As a result, the core remains coextensive with the inner and outer sheaths.

The inner shield may have an overlapped, a butt or a separated seam. While it has been conventional for the outwardly facing surface of the inner shield to be bonded to the inner jacket in order to provide hoop strength for the cable, it has been found that adequate hoop strength may be provided without any bonding. Advantageously, the use of an unbonded inner sheath system allows more effective contraction of the inner sheath about the core because of slippage of the longitudinal edge portions of the inner shield.

The aerial environment for these cables exposes them to a broader scope of damage than buried cable. While buried cable must resist the damaging effects of causes such as lightning hits and gopher bites which render the core susceptible to underground moisture, aerial cable must also resist the elements, tree abrasion, shotgun blasts, and electrical burns occasioned by contact with power lines. Advantageously, it has been found that the cable of this invention not only prevents interruption to service as a result of animal attacks, but also as a result of the other above-mentioned causes.

BRIEF DESCRIPTION OF THE DRAWINGS

Other features of the present invention will be more readily understood from the following detailed description of specific embodiments thereof when read in conjunction with the accompanying drawings, in which.

DETAILED DESCRIPTION

Figures 1, 2, 3, 4:
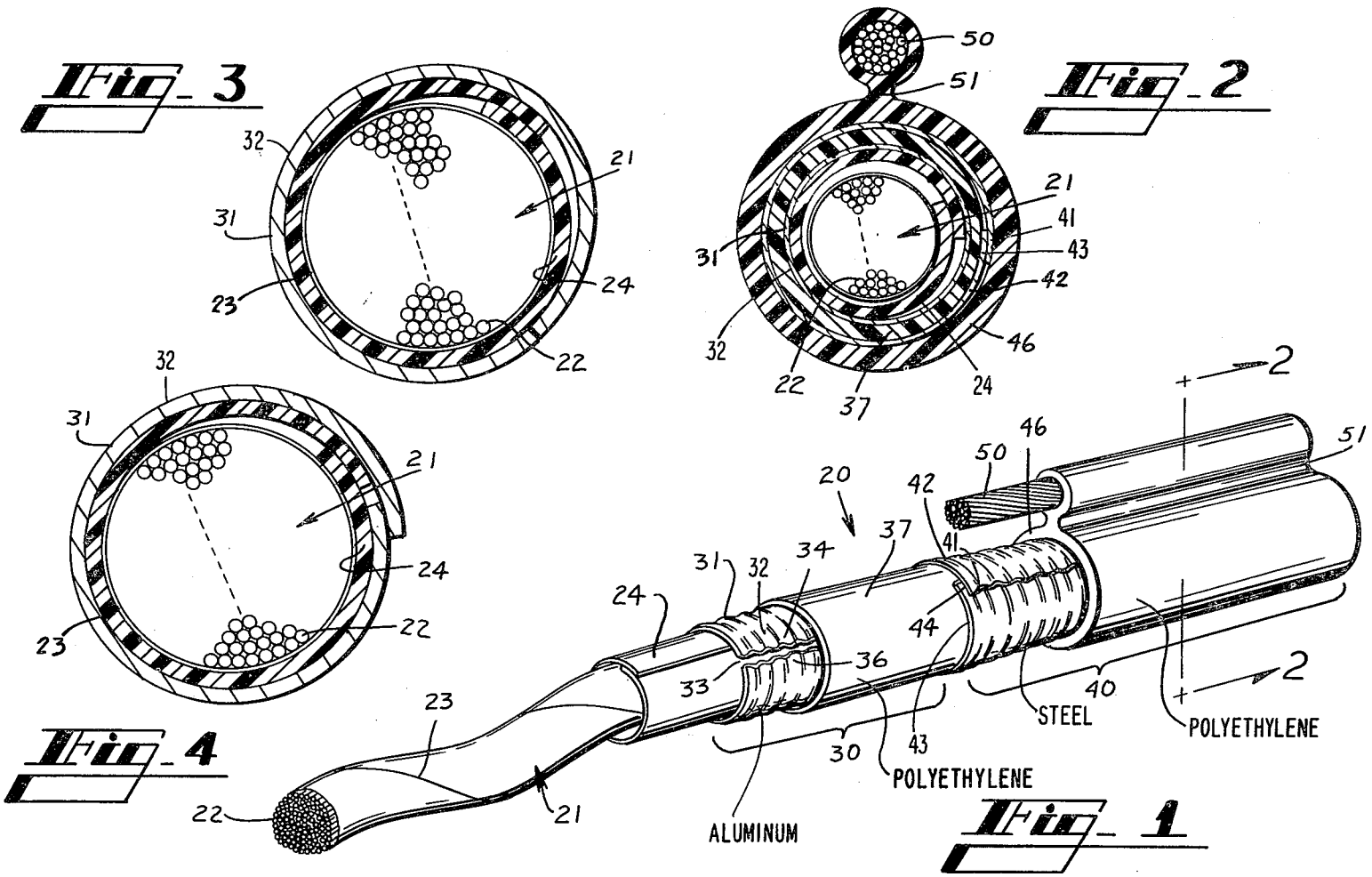
FIG. 1 is a perspective view of a cable of this invention which is particularly suited for aerial installations.
FIG. 2 is an end view in section of the cable of FIG. 1 and taken along lines 2—2 thereof.
FIGS. 3 and 4 are cross-sectional views of a portion of the cable of this invention to show alternate embodiments of a seam of an inner shield.

Referring now to FIG. 1 there is shown a cable of this invention which cable is designated by the numeral 20. The cable 20 is particularly suited for aerial installations in that it is a so called self-supporting cable which may be strung between poles without being lashed to a separate support strand. Moreover, the cable 20 includes provisions for resisting attacks by animals and for preserving its transmission capabilities notwithstanding damages brought on by animals or other forces because of its exposure.

The cable 20 includes a core 21 which comprises a plurality of individually insulated conductors 22—22. Typically, a cable 20 of this invention may include as few as six pairs of insulated conductors 22—22 or as many as three hundred pairs. The core 21 is undulated in form as disclosed in hereinfore-identified U.S. Pat. No. 3,207,836 which is incorporated by reference hereinto. The core 21 is bound with a binder 23 and enclosed in a core wrap 24 which is preferably made of a polyester plastic material such as for example a Mylar® plastic film, a product of the DuPont Company.

The core 21 and its wrap 24 are enclosed in an inner sheath system which is designated generally by the numeral 30. The inner sheath system 30 includes an inner shield 31 which is made of a corrugated metallic tape such as aluminum, for example. In a preferred embodiment, an outwardly facing surface 32 of the shield 31, which has a thickness of about 0.0008 cm, is coated with an ethylene acrylic acid copolymer adhesive material which is capable of causing a bond between the shield and another plastic covering material. The coated aluminum tape may be one such as that marketed by the Dow Chemical Company under the trademark Zetabon® plastic clad metal.

As can be seen in FIG. 1, the shield 31 is wrapped about the core 21 to form a longitudinal seam 33 in which longitudinal edge portions 34 and 36 are spaced apart to have a gap therebetween. In other embodiments shown in FIGS. 3 and 4, the longitudinal edge portions may be either overlapped or engaged to form a butt joint.

The inner sheath system 30 also includes an inner jacket 37 which encloses the shield 31 and which is bonded to the outwardly facing surface of the shield. Typically, the inner jacket is made of a plastic material such as polyethylene and is extrusion covered over the inner shield 31 such that its thickness is about 0.14 cm.

Additional protection of the core 21 from the elements and from external forces is achieved by an outer sheath system which is designated generally by the numeral 40. The outer sheath system 40 includes an outer shield 42 that is corrugated and that in a preferred embodiment is made of steel. The shield 42 is made from a steel tape having a thickness of about 0.015 cm, and is wrapped about the inner jacket 37 so that the longitudinal edge portions 41 and 43 form a longitudinal seam 44 in which the edge portions are overlapped by about 0.6 cm. In order to provide the cable 20 with superior water resistant capabilities, the steel shield 42 is flooded with a material such as for example atactic polypropylene.

Of significance is the arrangement of the longitudinal seam 44 of the outer shield 42. In order to provide the outer shield 42 with a degree of freedom that will enable it to cause a contraction of the inner sheath system, the overlapping portions of the seam 44 are not joined. In this way they are free to slide relative to each other in a circumferential direction. If they are caused to slide so as to reduce the diameter of the outer shield, the outer shield will effectively squeeze that which it encloses, i.e. the inner sheath system 30. The formation of the steel shield 42 causes the shield to impart compressive forces to the inner jacket 37 since the overlapping portions of the shield 42 are free to slide in a circumferential direction.

This is a significant improvement over previously used soldered seams of steel shields which were oversized to permit their soldering. Because of the solder seam constraint and the inherent rigidity of steel, the overlapping edge portions were restrained from moving. As a result, the undulated core could move relative to the inner shield. If the shield system moved when the cable assumed its catenary during shape installation between poles, the core would slip with respect thereto and become withdrawn within the shields.

The outer sheath system 40 also includes an outer jacket 46 which is made of a plastic material such as polyethylene for example and which has a thickness of about 0.13 cm. The outer jacket 46 which encloses the steel shield 42 is a first line of defense to damaging forces and should it suffer penetration, the steel shield 42 is an effective deterrent to further penetration.

As can be seen in FIGS. 1 and 2, the outer jacket 46 also has a portion which encloses a stranded member 50 which is parallel to the longitudinal centerline of the cable but which is spaced from the outer shield. The elongated stranded member 50 is preferably made of a high strength steel and has a diameter of about 0.6 cm. The steel strand 50 provides the cable with a self-supporting capability to enable it to be strung between supports such as poles without having to lash it to a separate supporting cable.

The portion of the jacket 46 which encloses the steel strand 50 is connected to the portion which encloses the core by a web 51. Preferably, the web 51 has a thickness of about 0.15 cm and has a height of about 0.23 cm.

The extrusion of the outer jacket 46 and its subsequent cooling causes the jacket to contract which causes compressive forces to be applied to the steel shield 42. This causes the shield 42 to apply another increment of compressive forces to the inner sheath system to further contract the inner sheath system about the core. However, it has been determined that the majority of the contraction of the sheath system about the core is caused during the formation of the steel shield 42.

As will be recalled, the outwardly facing surface of the inner shield 31 may be bonded to the inner jacket 37. This has been done to provide suitable hoop strength to the cable structure to prevent unwanted physical distortions during installation and during use. It has been found that the cable 20 has sufficient hoop strength to resist these distortions without the need for a bonded inner jacket shield system. Advantageously, the elimination of the bond between the inner jacket 37 and the inner shield 31 allows a more effective transfer of compressive forces from the outer sheath system 40 to the core 21. As a result, the contraction of the passage in which the undulated core 21 is housed can more suitably be controlled to hold the core coextensive with the sheath systems.

Figure 5:
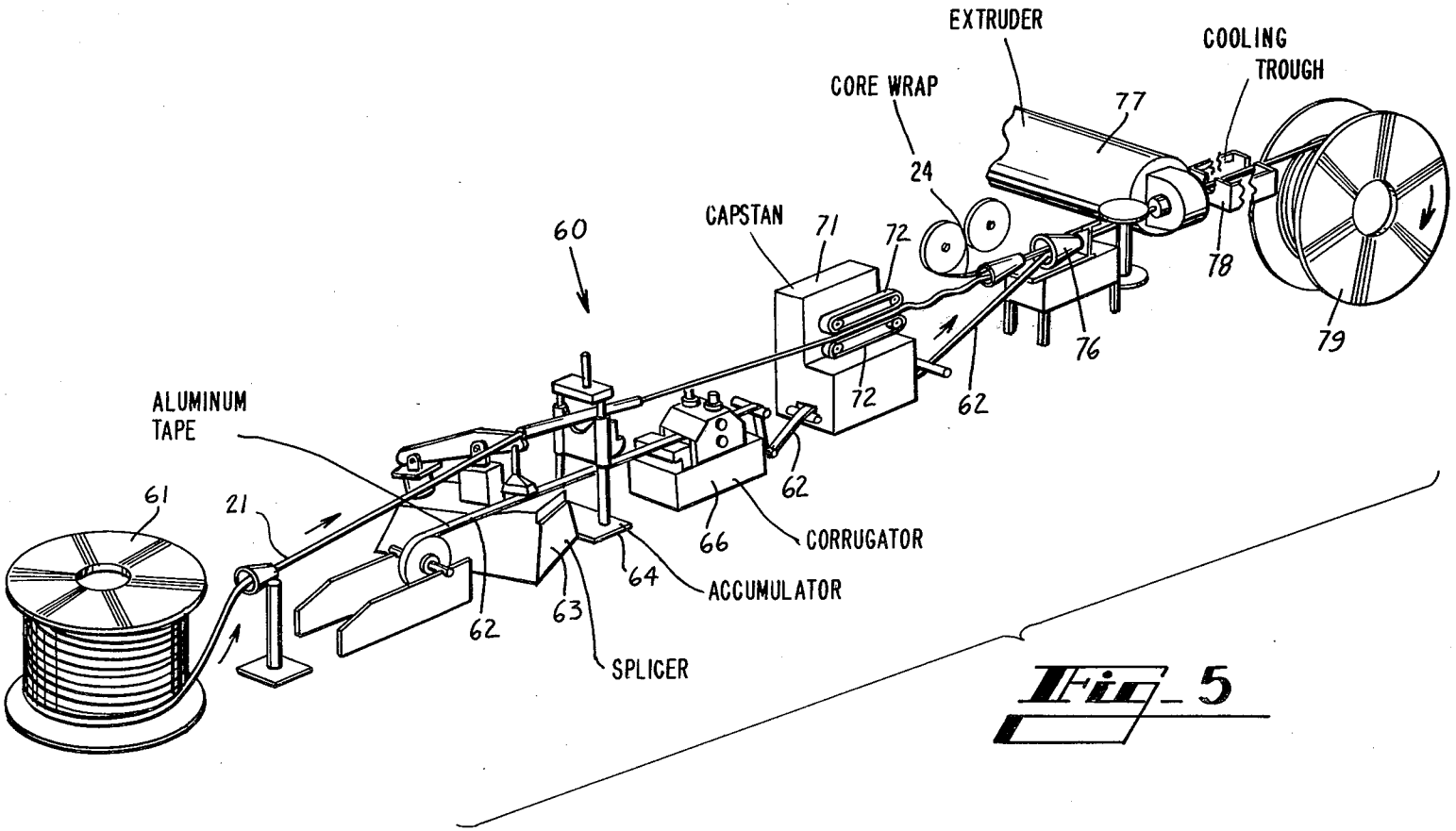
FIGS. 5 and 6 are perspective views of portions of a manufacturing line which is used to manufacture the cable shown in FIG. 1.

In a method of making the cable 20 of this invention, reference is made to a manufacturing line which is designated generally by the numeral 60 and which is shown in FIG. 5. The core 21 is payed off a supply truck 61 and advanced past several stands below which an aluminum tape 62 is passed. The aluminum tape 62 is advanced past a splicing apparatus 63 and an accumulator 64 after which it is corrugated in a predetermined manner by a corrugating unit 66.

As the aluminum tape 62 is being advanced beneath it, the core 21 is being undulated as it is advanced through a tractor capstan 71 such as that disclosed in priorly mentioned U.S. Pat. No. 3,207,836. The core passes between opposing belts 72—72 which carry U-shaped guiding and forming elements (not shown) alternately spaced on opposing belts. The open ends of the U-shaped members of the respective belts 72—72 overlap each other as they engage the core 21 and, as a result, the core is forced into an undulated form while it is being monitored by a loop control (not shown).

Then the undulated core 21 is enclosed in the core wrap 24 and the enclosed core and corrugated aluminum tape 62 are fed into a cone former 76 wherein the aluminum tape is wrapped about the core in a manner to form the shield 31 having the longitudinally extending seam 33. The inner diameter of the aluminum shield 31 is controlled so as not to reduce the amplitude of the undulations below a predetermined amount. In applying the aluminum tape 62, its edges are placed in spaced relationship to form a gap which may be closed at least partially during ensuing steps.

In the final step on the line 60, the shield-enclosed core 21 is advanced through an extruder 77 wherein an inner jacket 37 of polyethylene is caused to be formed about the core and shield. Following the extrusion of the inner jacket 37, the partially completed cable is moved through a trough 78 wherein it is cooled in a medium such as water after which it is taken up on a reel 79.

Figure 6:
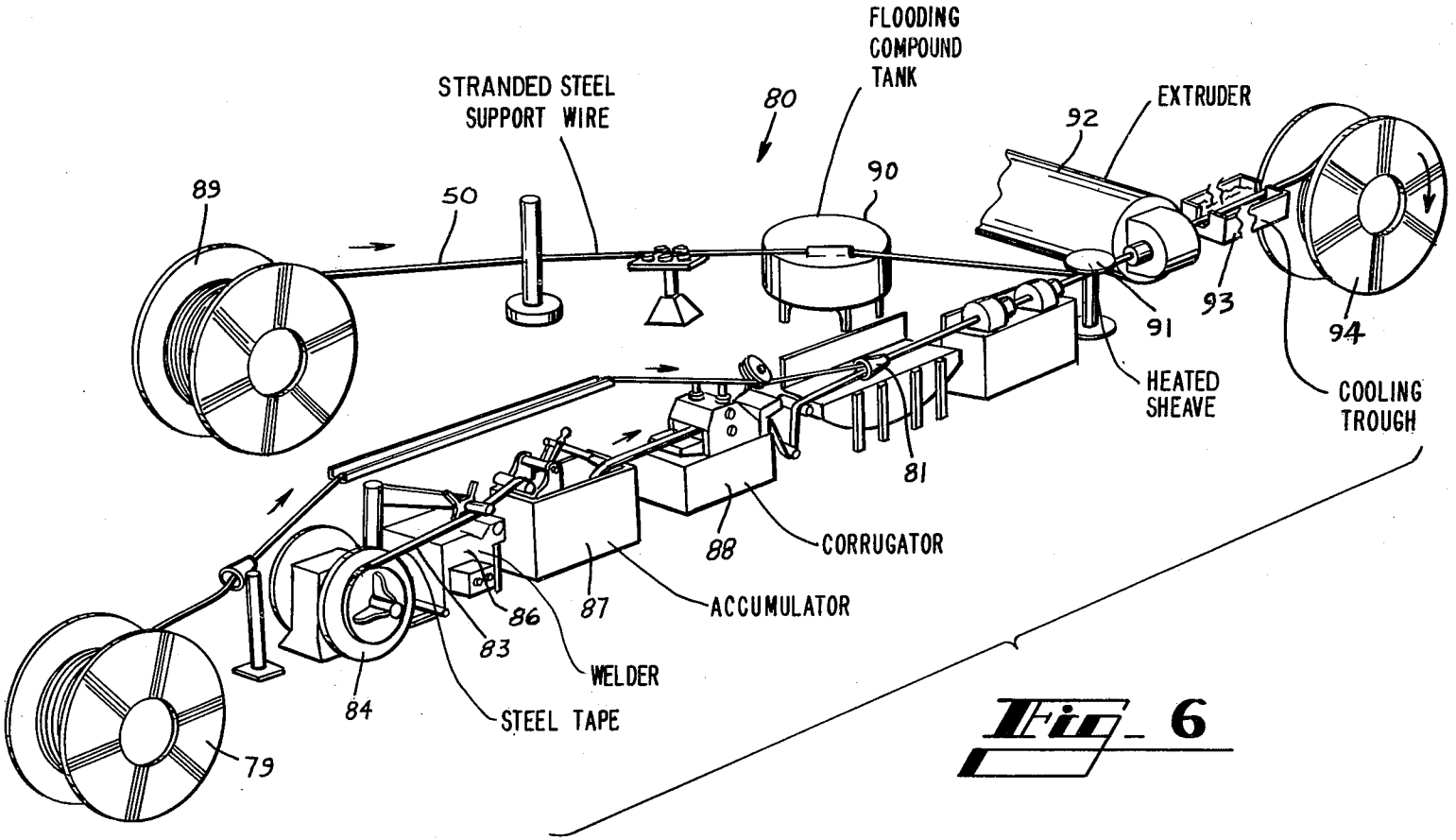

Going now to FIG. 6, there is shown another manufacturing line, which is designated generally by the numeral 80, and which is used to complete the manufacture of the cable of this invention. The partially completed cable which was processed on the line 60 is fed off the reel 79 and advanced toward a cone former 81. Meanwhile, a steel tape 83 is fed from a supply 84 through a welder 86, an accumulator 87 and through a corrugator 88. After the tape 83 has been corrugated, it is fed into the cone former 81 where it is caused to be wrapped about the inner sheath system to form an outer shield 42 having an overlapped longitudinal seam 44. The seam 44 is formed such that longitudinal edge portions of the tape are overlapped about 0.6 cm.

As the corrugated steel shield 42 is formed about the enclosed core, the former 81 causes the shield to apply compressive forces to the inner sheath 30. This causes the inner sheath system 30 to become squeezed about the core 21 to engage the core such that it does not withdraw within the sheath system when the cable 20 is strung in a catenary.

Subsequently, the stranded steel support wire 50 from a supply reel 89 is advanced through a tank 90 which causes a thermoplastic flooding compound to be applied to the wire. Then the wire 50 and the partially completed cables are advanced past a heated sheave 91 and into an extruder 92. The extruder 92 causes the stranded steel wire 50 and the sheathed core to be enclosed in a common outer jacket 46 which has a thickness of about 0.13 cm about the core 21 and a thickness of about 0.15 cm about the stranded wire. The outer jacket 46 is formed so that the portion about the stranded wire 50 is connected by a web 51 to the portion about the core 21. The web 51 has a thickness of about 0.15 cm and a height of about 0.23 cm. Then the cable 20 of this invention is advanced through a water trough 93 where the jacket is cooled and then is taken up on a reel 94. In one embodiment, the seam 44 of the shield 42 is aligned with the web 51.

It is to be understood that the above-described arrangements are simply illustrative of the invention. Other arrangements may be devised by those skilled in the art which will embody the principles of the invention and fall within the spirit and scope thereof.

What is claimed is:

1. A communications cable, which is self-supporting when strung between two support points, said cable comprising:

a core which comprises a plurality of individually insulated conductors, said core being in an undulated form and having a predetermined amplitude;

an inner sheath system which comprises:

a shield which is made of a first metallic material and which encloses said core; and an inner jacket which is made of a plastic material and which encloses said shield;

a metallic support strand which extends longitudinally with but which is spaced from said core; and an outer sheath system which comprises:

a shield which is made of a second metallic material and which encloses said inner sheath system, said shield of said outer sheath system being wrapped about said plastic jacket of said inner sheath system with longitudinal edge portions thereof forming a longitudinal overlapped unjoined seam; and an outer jacket which is made of a plastic material and which encloses said shield which is made of a second metallic material and said metallic support strand, said outer sheath system being effective to cause said inner sheath system to be in compressive engagement with portions of said core to substantially prevent relative movement of said core with respect to said inner sheath system.

2. The cable of claim 1, wherein said overlapped unjoined longitudinal edge portions of said shield of said outer sheath system which form said longitudinal seam are capable of moving relative to each other in a circumferential direction.

3. A communications cable which is self-supporting when strung between two support points, said cable comprising:

a core which comprises a plurality of individually insulated conductors, said core being in an undulated form having a predetermined amplitude;

a first metallic strip which is wrapped longitudinally about said core to form a longitudinal seam;

an inner jacket which encloses said first metallic strip, said inner jacket comprising a polymeric material;

a second metallic strip which is disposed about said inner jacket to form a longitudinal overlapped unjoined seam;

a metallic support strand which extends longitudinally with said second metallic strip and which is spaced therefrom; and an outer jacket which is made of a polymeric material and which encloses said second metallic strip and said support strand.

4. The cable of claim 3 wherein said outer jacket includes a portion which encloses said support strand and a portion which encloses said second metallic strip, said portions of said outer jacket which enclose said support strand and said second metallic strip being connected by a web, said longitudinal seam of said second strip being aligned with said web which connects said two portions of said outer jacket.

5. A method of making a communications cable, which is self-supporting when strung between two support points, said method comprising the steps of:

advancing a core which includes a plurality of individually insulated conductors along a path;

causing said core to assume an undulated configuration;

wrapping successive portions of a first metallic tape about the core to form a first shield having a longitudinal seam;

enclosing said first shield in an inner jacket of plastic material;

wrapping successive portions of a second metallic tape about the inner jacket to form a second shield having a longitudinal overlapped unjoined seam; while, controlling the formation of the overlapped unjoined longitudinal seam of said second metallic tape to cause compressive forces to be applied to the inner jacket and the first shield so that they contract a predetermined amount about the core and cause the first shield to engage portions of the core;

advancing a metallic strand into juxtaposition with said core; and enclosing the strand and the core in an outer jacket having a portion which encloses said second shield and a portion which encloses said strand, said portions spaced from each other by a web.

* * * * *